US009250573B2

(12) United States Patent
Matsumoto

(10) Patent No.: US 9,250,573 B2
(45) Date of Patent: Feb. 2, 2016

(54) IMAGE FORMING APPARATUS

(71) Applicant: CANON KABUSHIKI KAISHA, Tokyo (JP)

(72) Inventor: Atsushi Matsumoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/718,397

(22) Filed: May 21, 2015

(65) Prior Publication Data

US 2015/0338780 A1 Nov. 26, 2015

(30) Foreign Application Priority Data

May 23, 2014 (JP) ..... 2014-106710

(51) Int. Cl.
*G03G 15/08* (2006.01)
*G03G 15/09* (2006.01)

(52) U.S. Cl.
CPC ..... *G03G 15/0907* (2013.01); *G03G 15/0818* (2013.01); *G03G 15/0921* (2013.01); *G03G 15/0928* (2013.01); *G03G 2215/0609* (2013.01); *G03G 2215/0858* (2013.01); *G03G 2215/0861* (2013.01)

(58) Field of Classification Search
CPC ..... G03G 15/0818; G03G 15/0921; G03G 15/0928; G03G 15/0907; G03G 2215/0609; G03G 2215/0858; G03G 2218/0861
See application file for complete search history.

(56) References Cited

U.S. PATENT DOCUMENTS

| | | | | |
|---|---|---|---|---|
| 4,377,332 | A | 3/1983 | Tamura | |
| 7,702,264 | B2 | 4/2010 | Hirota et al. | |
| 8,934,817 | B2 | 1/2015 | Matsumoto | |
| 2003/0170050 | A1* | 9/2003 | Terai | G03G 15/0921 399/267 |
| 2008/0080905 | A1 | 4/2008 | Hirota et al. | |
| 2009/0208255 | A1* | 8/2009 | Yamada | G03G 15/0818 399/286 |
| 2009/0297231 | A1* | 12/2009 | Aruga | G03G 15/0818 399/285 |

(Continued)

FOREIGN PATENT DOCUMENTS

| | | | |
|---|---|---|---|
| JP | 54-079043 | A | 6/1979 |
| JP | 64-5711 | B2 | 1/1989 |
| JP | 1-032506 | A | 7/1989 |

(Continued)

OTHER PUBLICATIONS

Atsushi Matsumoto, U.S. Appl. No. 14/714,532, filed May 18, 2015.
Atsushi Matsumoto, U.S. Appl. No. 14/718,197, filed May 21, 2015.

*Primary Examiner* — Joseph S Wong
(74) *Attorney, Agent, or Firm* — Fitzpatrick, Cella, Harper & Scinto

(57) ABSTRACT

An image forming apparatus includes: a developer carrying member (sleeve) including a magnet and grooves; and an image bearing member (drum). The electrostatic image on the drum is developed with a developer. When a linear speed of the sleeve is Vs, a linear speed of the drum is Vd, a peripheral speed ratio of the sleeve to the drum is $\alpha$=Vs/Vd, a radius of the sleeve is Rs, a radius of the drum is Rd, a distance of a rectilinear line connecting a most upstream point and a most downstream point in the developing region with respect to the circumferential direction is Lnip, a pitch of the grooves of the sleeve is p, and an arbitrary natural number is n, the following relationship is satisfied:

$$(1-0.05)\times np \leq 2[\alpha\times Rd\times\arcsin(Lnip/2Rd)-Rs\times\arcsin(Lnip/2Rs)] \leq (1+0.05)\times np.$$

3 Claims, 14 Drawing Sheets

(56) References Cited

U.S. PATENT DOCUMENTS

| | | | |
|---|---|---|---|
| 2012/0251185 | A1 | 10/2012 | Matsumoto |
| 2012/0269555 | A1 | 10/2012 | Matsumoto et al. |
| 2015/0010335 | A1 | 1/2015 | Akita et al. |
| 2015/0071683 | A1 | 3/2015 | Takahashi et al. |

FOREIGN PATENT DOCUMENTS

| | | | |
|---|---|---|---|
| JP | 05-249833 | A | 9/1993 |
| JP | 2000-122403 | A | 4/2000 |
| JP | 2000-321864 | A | 11/2000 |
| JP | 2008-083474 | A | 4/2008 |

* cited by examiner (a)

(b)

(a)

(b)

IMAGE FORMING APPARATUS

FIELD OF THE INVENTION AND RELATED ART

The present invention relates to an image forming apparatus for forming an image using an electrophotographic process.

Japanese Laid-Open Patent Application 2000-321864 discloses an image forming apparatus including a developing roller having V-shaped grooves, each extending in an axial direction, provided at a plurality of positions with respect to a circumferential direction. When such a developing roller is used, compared with the case of a conventional developing roller subjected to blasting, an anti-wearing property of the developing roller is improved.

However, in the image forming apparatus disclosed in Japanese Laid-Open Patent Application 2000-321864, a developer forms chains extending from the V-shaped grooves as starting points, and therefore non-uniformity of the chains' grooves on the developing roller corresponds to projections and recesses (unevenness) formed by the V-shaped grooves. For this reason, in some cases, image density non-uniformity corresponding to the non-uniformity of the chains on the developing roller grooves exists on a toner image on a photosensitive drum.

SUMMARY OF THE INVENTION

The present invention has been accomplished in view of the above-described circumstances. A principal object of the present invention is to provide an image forming apparatus capable of suppressing generation of image density non-uniformity, on a surface of an image bearing member, due to a plurality of grooves formed on an outer surface of a developing roller with a predetermined interval with respect to a circumferential direction.

According to an aspect of the present invention, there is provided an image forming apparatus comprising: a developer carrying member capable of carrying a developer containing a toner and a carrier, wherein the developer carrying member includes therein a magnet having a plurality of magnetic poles disposed along a circumferential direction thereof and includes a plurality of grooves formed at an outer surface thereof with a predetermined interval with respect to the circumferential direction; and an image bearing member, provided opposed to the developer carrying member, for bearing an electrostatic image, wherein the electrostatic image on the image bearing member is developed with the developer carried on the developer carrying member by applying a developing bias including an AC electric field to a developing region which is an opposing portion between the developer carrying member and the image bearing member, and wherein when a linear speed of the developer carrying member is Vs, a linear speed of the image bearing member is Vd, a peripheral speed ratio of the developer carrying member to the image bearing member is $\alpha$=Vs/Vd, a radius of the developer carrying member is Rs, a radius of the image bearing member is Rd, a distance of a rectilinear line connecting a most upstream point and a most downstream point in the developing region with respect to the circumferential direction is Lnip, a pitch of the grooves of the developer carrying member is p, and an arbitrary natural number is n, the following relationship is satisfied:

$$(1-0.05)\times np \leq 2[\alpha\times Rd\times \arcsin(Lnip/2Rd)-Rs\times \arcsin(Lnip/2Rs)] \leq (1+0.05)\times np.$$

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 19 is a graph in which density non-uniformity peak values at portions corresponding to a period of grooves appearing on the photosensitive drum in the case where only a peripheral speed ratio $\alpha$ is finely changed are plotted while fixing a diameter of the photosensitive drum, a diameter of the developing sleeve, a shape of grooves and the like.

DESCRIPTION OF EMBODIMENTS

With reference to the drawings, embodiments of the present invention will be described specifically. However, dimensions, materials, shapes, relative arrangements, and the like of constituent elements (parts) described in the following embodiments are appropriately changed depending on constitutions and various conditions of an apparatus (device) to which the present invention is applied, and therefore the scope of the present invention is not limited thereto unless otherwise specified.

Embodiment 1

Figure 1:
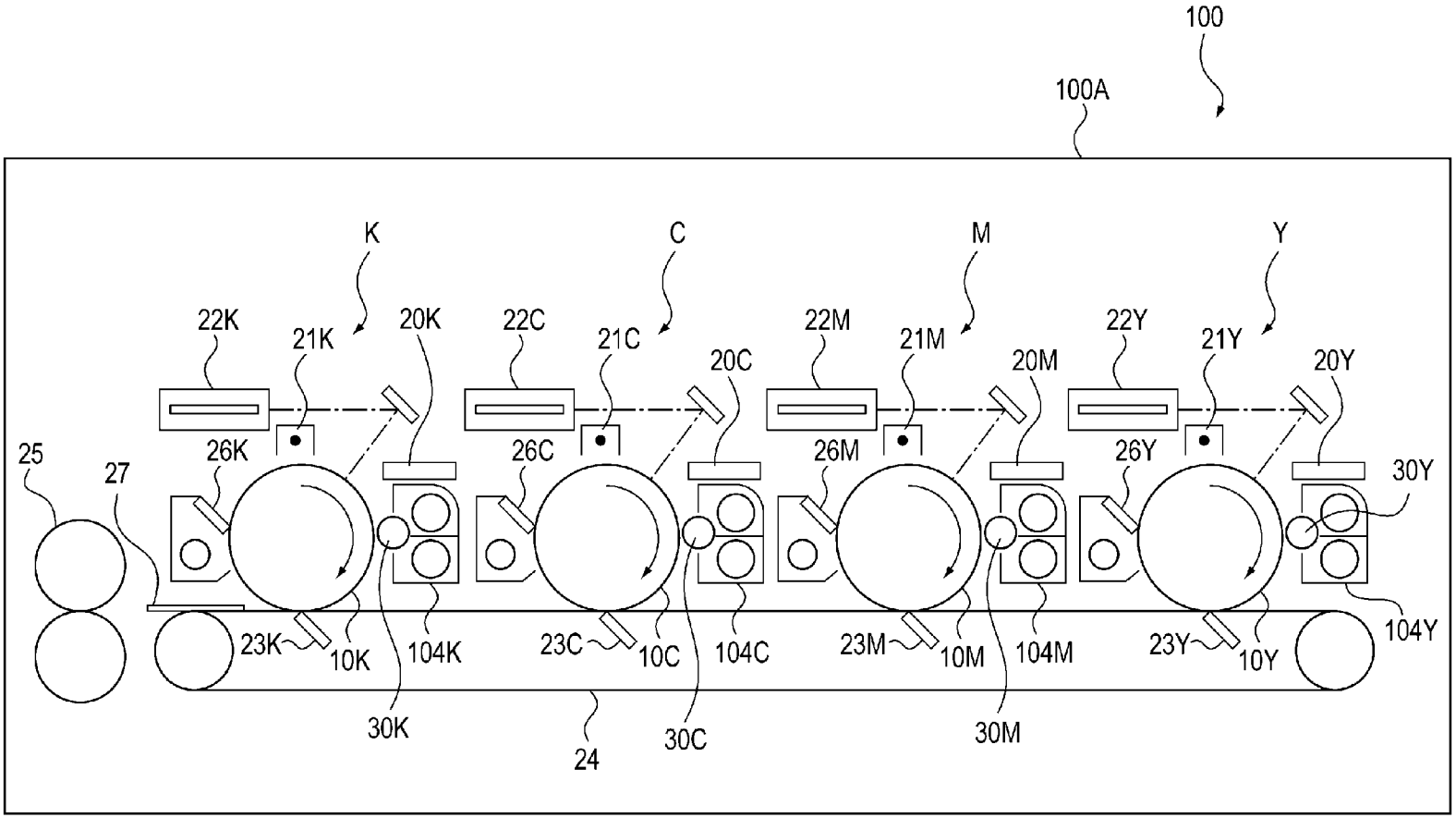
FIG. 1 is a sectional view of an image forming apparatus according to Embodiment 1.

FIG. 1 is a sectional view of an image forming apparatus 100 according to Embodiment 1. The image forming apparatus 100 shown in FIG. 1 is a full-color image forming apparatus. Stations Y, M, C and K have substantially the same constitution and form images of yellow (Y), magenta (M), cyan (C) and black (K), respectively, for a full-color image. In the following description, e.g., a developing device 104 is used in common to developing devices 104Y, 104M, 104C and 104K at the stations Y, K, C and K. This is true for reference numerals 10, 20, 21, 22, 23, 26 and 30 described later.

First, an operation of an entire image forming apparatus 100 will be described. A photosensitive drum 10 as an image bearing member is provided opposed to a developing roller 30 and is a member for bearing an electrostatic image. The photosensitive drum 10 is rotatably provided, and is electrically charged uniformly by a primary charger 21 and then is exposed to light modulated depending on an information signal by a light emitting element 22 such as a laser, so that an electrostatic image is formed. The electrostatic image is visualized as a toner image (developer image) by the developing device 104 in a process described later.

The toner image is transferred, every station by a first transfer charger 23, onto a transfer material 27 as a recording material fed by a transfer material feeding sheet 24, and thereafter is fixed by a fixing device 25 to obtain a permanent image. A transfer residual toner remaining on the photosensitive drum 10 is removed by a cleaning device 26. The toner in an amount corresponding to that of the toner contained in the developer T consumed by image formation is supplied from a toner supplying container 20.

In this embodiment, a method in which the toner images are directly transferred from the photosensitive drums 10Y, 10M, 10C and 10K onto the transfer material 27 fed by the transfer material feeding sheet 24 is employed. However, the present invention is also applicable to a constitution in which an intermediary transfer member is provided in place of the transfer material feeding sheet 24. In this case, the respective color toner images are, after being primary-transferred from the respective photosensitive drums 10Y, 10M, 10C and 10K onto the intermediary transfer member, collectively secondary-transferred onto the transfer material.

[Two-Component Developer]

Next, the two-component developer used in this embodiment is described. The toner contains colored particles made up of a binder resin, a coloring agent, colored resin particles containing other additives as desired, and external additives such as fine powder of colloidal silica. Further, the toner is formed of a negatively chargeable polyester resin material and is 7.0 μm in volume-average particle size in this embodiment.

As the material for the carrier, surface-oxidized or non-oxidized particles of a metallic substance, such as iron, nickel, cobalt, manganese, chrome, rare-earth metal and their alloys, or oxidized ferrite, and the like, can be suitably used. The method for manufacturing these magnetic particles is not particularly limited. In this embodiment, the carrier which was 40 μm in volume average particle size, $5\times10^8$ Ω.cm in volume resistivity, and 260 emu/cc in magnetization was used.

<Operation of Developing Device>

Figure 2:
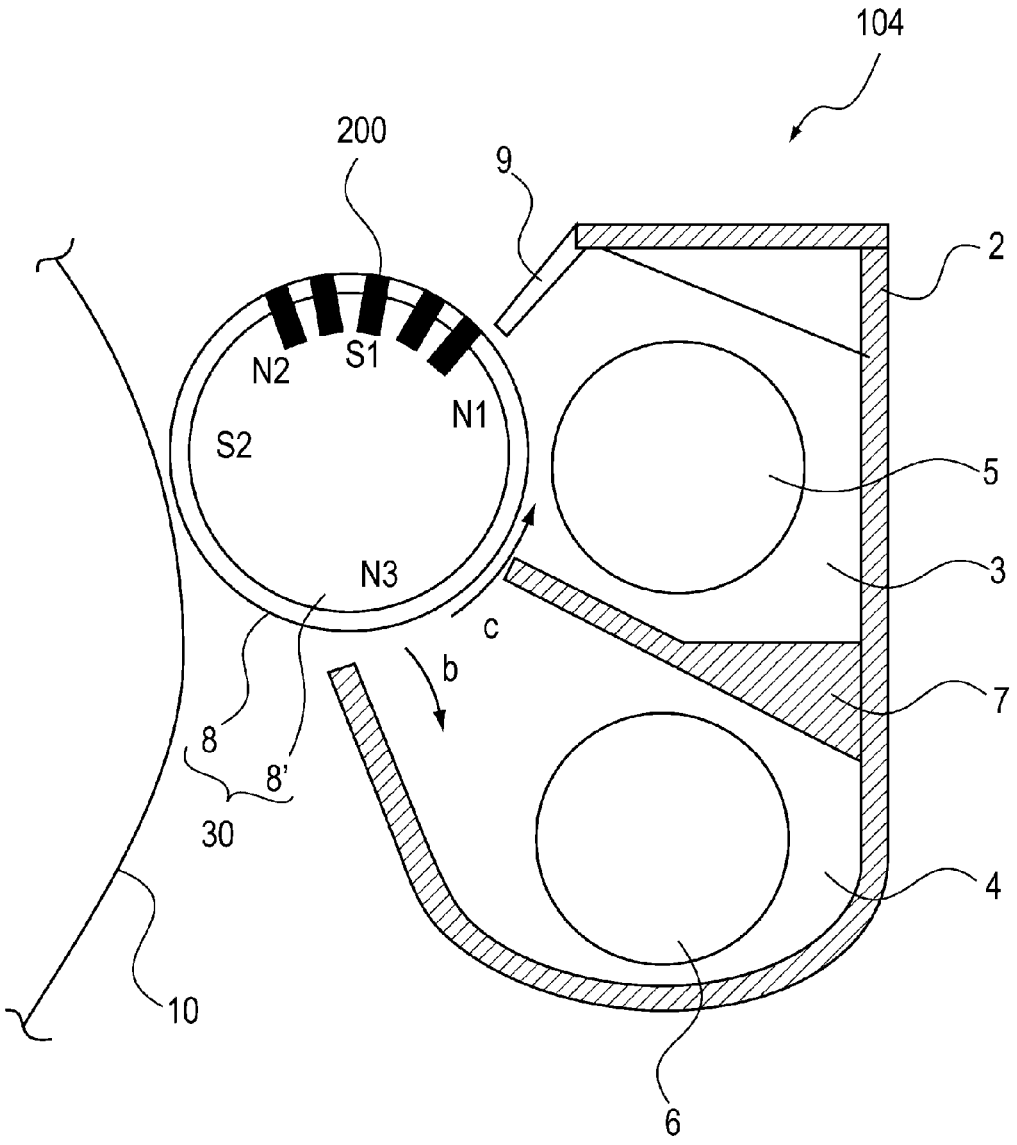
FIG. 2 is a sectional view of a developing device.

FIG. 2 is a sectional view of the developing device 104. An operation of the developing device 104 will be described with reference to FIG. 2. The developing device 104 in this embodiment includes a developing container 2, in which the two-component developer containing a non-magnetic toner and a magnetic carrier is accommodated, and a developing roller 30 and a regulating blade 9. The developing roller 30 is a developer carrying member capable of carrying the developer T containing the toner and the carrier. The developing roller 30 includes a developing sleeve 8 in which a magnet roller 8' having a plurality of magnetic poles disposed along a circumferential direction is provided. The developing roller 30 is provided with a plurality of grooves each extending in an axial direction with a predetermined interval with respect to the circumferential direction on an outer surface thereof.

The image forming apparatus 100 causes a developing bias including an AC electric field to act on a developing region which is an opposing portion between the developing roller 30 and the photosensitive drum 10, so that the electrostatic image on the photosensitive drum 10 is developed with the developer T carried on the developing roller 30.

To the developing sleeve 8, the regulating blade 9 is provided opposed, and is a member for regulating, a layer thickness of the developer carried on the surface of the developing sleeve 8. The inside of the developing container 2 is vertically partitioned substantially at a central portion into a developing chamber 3 and a stirring chamber 4 by a partition wall 7 which extends in the direction perpendicular to the surface of the drawing sheet of FIG. 2, and the developer T is accommodated in the developing chamber 3 and the stirring chamber 4.

In the developing chamber 3 and stirring chamber 4, first and second feeding screws 5 and 6 are provided, respectively, as a circulating means for circulating the developer T in the developing container 2 while stirring and feeding the developer T. The first feeding screw 5 is provided at the bottom of the developing chamber 3 and is substantially parallel to the axial direction of the developing sleeve 8, and is rotated to feed the developer T in the developing chamber 3 along the axial direction of the developing sleeve 8. The second feeding screw 6 is provided at the bottom of the stirring chamber 4 and is substantially parallel to the first feeding screw 5, and feeds the developer T in the stirring chamber 4 in a direction opposite to that by the first feeding screw 5.

Thus, by feeding by rotation of the first and second feeding screws 5 and 6, the developer T in the developing device 104 is circulated between the developing chamber 3 and the stirring chamber 4 through openings (communication portions 71 and 72 in FIG. 4) provided at end portions of the partition wall 7.

Further, the developing container 2 is provided with an opening at a position corresponding to the developing region where the developing container 2 opposes the photosensitive drum 10. At this opening, the developing sleeve 8 is rotatably provided so as to be partly exposed toward the photosensitive drum 10. The developing sleeve 8 is constituted by a non-magnetic material, and inside the developing sleeve 8, the magnet roller 8', which is a magnetic field generating means, is disposed in a non-rotatable state. The magnetic roller 8' has a developing (magnetic) pole S2 and magnetic poles S1, N1, N2 and N3 for feeding the developer T.

Figure 3:
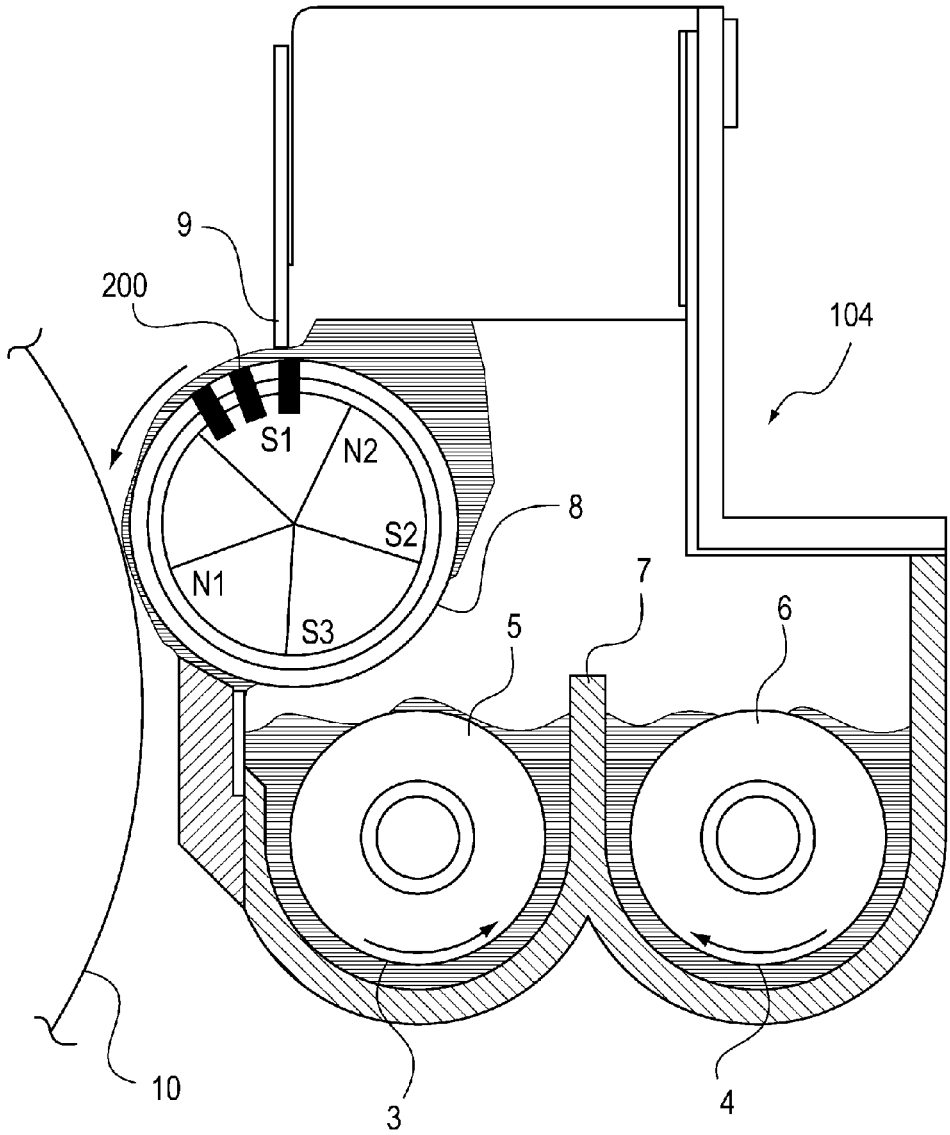
FIG. 3 is a sectional view of a modified example of the developing device.

Of these magnetic poles, a first magnetic pole N3 and a second magnetic pole N1 are adjacent to each other and are disposed inside the developing container 2. A repelling magnetic field is formed between the magnetic poles to form a barrier against the developer T, so that the developer T is separated in the stirring chamber 4. However, the partition manner between the developing chamber 3 and the stirring chamber 4 is not limited to the vertical partition manner as in this embodiment, but there is no problem even when a left-right partition manner as shown in FIG. 3 is employed. A chamber in which the developer T removed from the developing sleeve 8 by the barrier on the developing sleeve 8 is not limited to the stirring chamber 4, but there is no problem even when the developer T is collected in the developing chamber 3 (FIG. 3).

Referring again to FIG. 2, in this embodiment the developing sleeve 8 and the photosensitive drum 10 are 20 mm and 30 mm, respectively, in diameter, and the closest distance therebetween is about 300 μm. Setting is made so that the development can be effected in a state in which the developer T fed to the developing region (portion) is brought into contact with the photosensitive drum 10. Incidentally, the developing sleeve 8 is constituted by the non-magnetic material such as aluminum or stainless steel. Inside the developing sleeve 8, the magnet roller 8' is provided in a stationary (non-rotational) state.

The developing sleeve 8 rotates in an arrow direction (counterclockwise direction) in FIG. 2 during the development, and carries the two-component developer regulated in layer thickness by cutting of the chain of the magnetic brush with the regulating blade 9 opposing the second magnetic pole N1. Thus, the developing sleeve 8 feeds the developer T to the developing region where the developing sleeve 8 opposes the photosensitive drum 10. Then, the developing sleeve 8 supplies the developer T to the electrostatic latent image formed on the photosensitive drum 10 to develop the electrostatic image.

To the developing sleeve 8, a developing bias voltage in the form of a DC voltage biased with an AC voltage is applied from a power source in order to improve developing efficiency, i.e., a degree of impartment of the toner to the electrostatic image. In this embodiment, the DC voltage of −500 V and the AC voltage of 1300 V in peak-to-peak voltage (Vpp) and 10 kHz in frequency (f) were used. However, the DC voltage value and the AC voltage waveform are not limited thereto.

Further, in general, in a two-component magnetic brush developing method, when the AC voltage is applied, the developing efficiency is increased and thus the image is high in quality but is rather liable to cause fog. For this reason, the fog is prevented by providing a potential difference between the DC voltage applied to the developing sleeve 8 and a charge potential of the photosensitive drum 10 (i.e., a white background portion potential).

In the developing region, the developing sleeve 8 of the developing device 104 is rotated with the photosensitive drum 10 in the same direction as that of the photosensitive drum 10, and a peripheral speed ratio of the developing sleeve 8 to the photosensitive drum 10 is 1.581. The peripheral speed ratio may be set in a range of 0.5-2.5, preferably 1.0-2.0. When the movement (peripheral) speed ratio is larger, the developing efficiency is correspondingly increased. However, when the ratio is excessively large, problems of toner scattering, deterioration of the developer T and the like occur and therefore the peripheral speed ratio may preferably be set in the above-described ranges.

Further, the regulating blade 9 as the chain cutting member opposing the second magnetic pole N1 is constituted by a non-magnetic member formed of aluminum or the like in a plate shape extending along a longitudinal axial line direction of the developing sleeve 8, and is provided upstream of the photosensitive drum 10 with respect to the rotational direction of the developing sleeve 8.

Then, both of the toner and the carrier which constitute the developer T pass through the gap between an end of the regulating blade 9 and the developing sleeve 8 to be sent to the developing region. Incidentally, by adjusting the spacing (gap) between the end of the regulating blade 9 and the surface of the developing sleeve 8, a cutting amount of the chain of the magnetic brush of the developer carried on the developing sleeve 8 is regulated, so that the amount of the developer fed to the developing region is adjusted.

In this embodiment, a coating amount per unit area of the developer T on the developing sleeve 8 is regulated at 30 $mg/cm^2$ by the regulating blade 9.

In this embodiment, the coating amount per unit area of the developer T on the developing sleeve 8 is regulated at 30 $mg/cm^2$ by the regulating blade 9. The gap between the regulating blade 9 and the developing sleeve 8 is set at 200-1000 μm, preferably 300-700 μm. In this embodiment, the gap was set at 400 μm.

Figure 4:
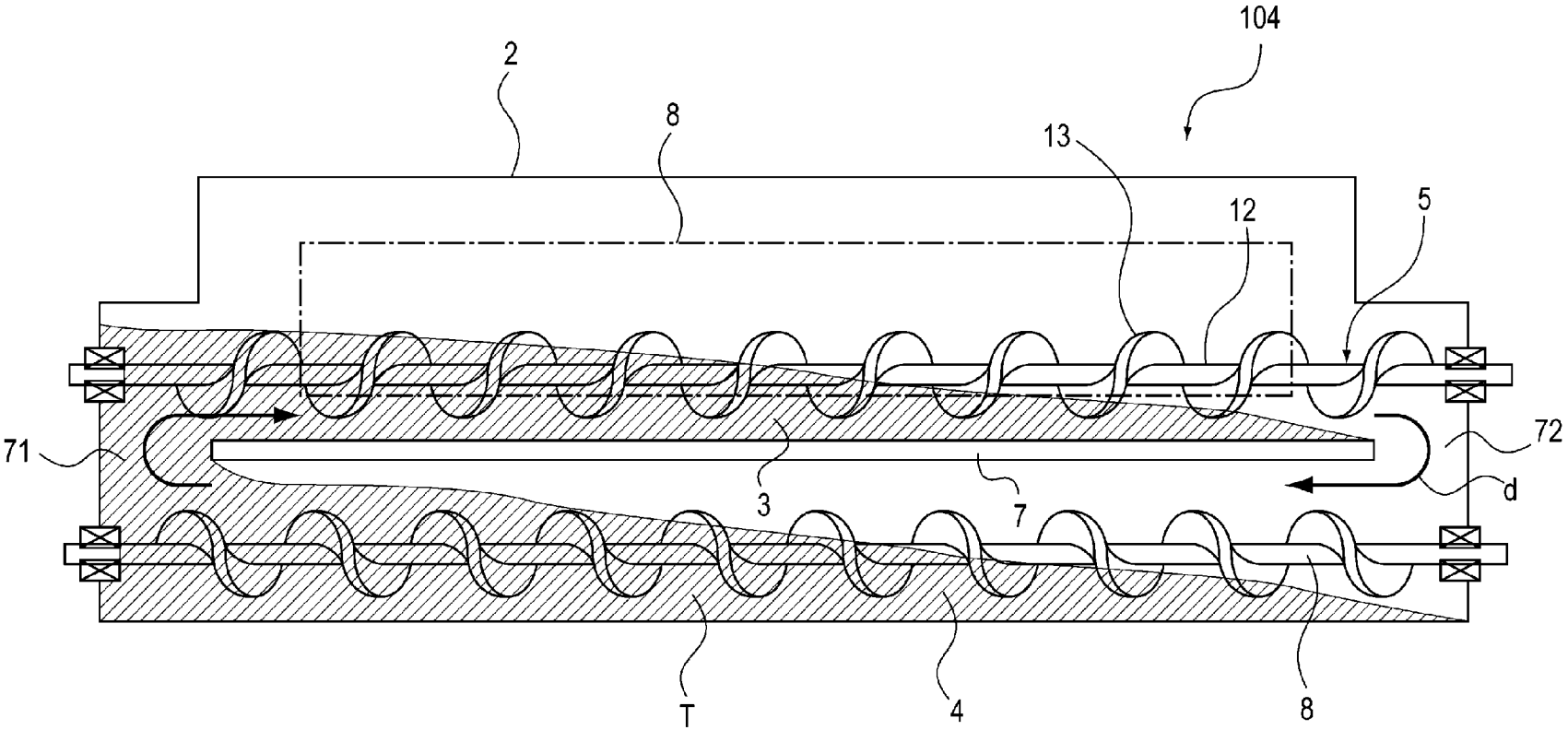
FIG. 4 is a sectional view of the developing device.

FIG. 4 is a sectional view of the developing device 104 as seen from the front surface side. The first feeding screw 5 is disposed at the bottom of the developing chamber 3 substantially in parallel to the developing sleeve 8 along the axial direction (developing width direction) of the developing sleeve 8. In this embodiment, the first feeding screw 5 includes a rotation shaft 12 constituted by a ferromagnetic material and a stirring blade 13 constituted around the rotation shaft 12 by the non-magnetic material so as to have a spiral screw structure. The first feeding screw 5 rotates to feed the developer T in the developing chamber 3 along the axial direction of the developing sleeve at the bottom of the developing chamber 3.

Also the second feeding screw 6 includes, similarly as in the case of the first feeding screw 5, the rotation shaft and the stirring blade provided around the rotation shaft so as to have a spiral screw structure in which the spiral direction is opposite from that of the first feeding screw 5. The second feeding screw 6 is disposed substantially in parallel to the first feeding screw 5 at the bottom of the stirring chamber 4 and rotates in the same direction as the first feeding screw 5, so that the developer T in the stirring chamber 4 is fed in a direction opposite to that of the first feeding screw 5.

By the rotation of the first and second feeding screws 5 and 6 as described above, the developer T is circulated between the developing chamber 3 and the stirring chamber 4. Further, in the developing device 104, the developing chamber 3 and the stirring chamber 4 are vertically disposed (FIG. 2), so that the developer T fed from the developing chamber 3 to the stirring chamber 4 moves from above to below, and the developer T fed from the stirring chamber 4 to the developing chamber 3 moves from below to above. Particularly, from the stirring chamber 4 to the developing chamber 3, the developer T is delivered so as to be pushed from below to above by pressure of the developer T accumulated at an end portion.

A peripheral speed ratio, which is a feature of this embodiment, of the developing sleeve 8 to the photosensitive drum 10 will be described in detail. In the developing sleeve 8 provided with the magnet roller 8' therein in general, in order to improve a feeding property of the developer T, a means for roughening the surface of the developing sleeve 8 is employed. As such a means, blasting in which hard fine particles are projected onto the developing sleeve 8 is employed (e.g., Japanese Patent Publication Hei 1-5711 and Japanese Patent Publication Hei 1-32506). However, the developing sleeve surface-roughened by the blasting is accompanied with a problem that the developing sleeve is liable to be worn during use to result in inferior durability.

As a method for solving the problem, there is a means for forming a roughened surface of the developing sleeve by knurling (grooving) (e.g., Japanese Laid-pen Patent Application Sho 54-79043). As a result, an anti-wearing performance of the developing sleeve 8 is remarkably improved.

Figure 5:
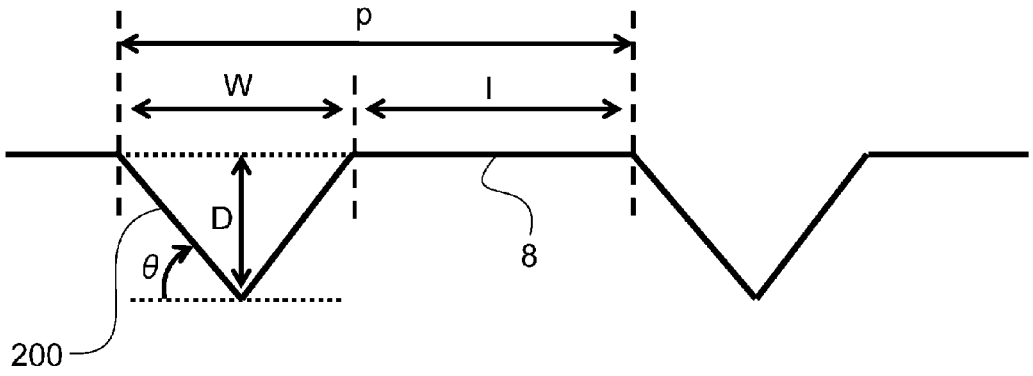
In FIG. 5, (a) and (b) are sectional views each showing grooves formed on a developing sleeve.
Figure 5:
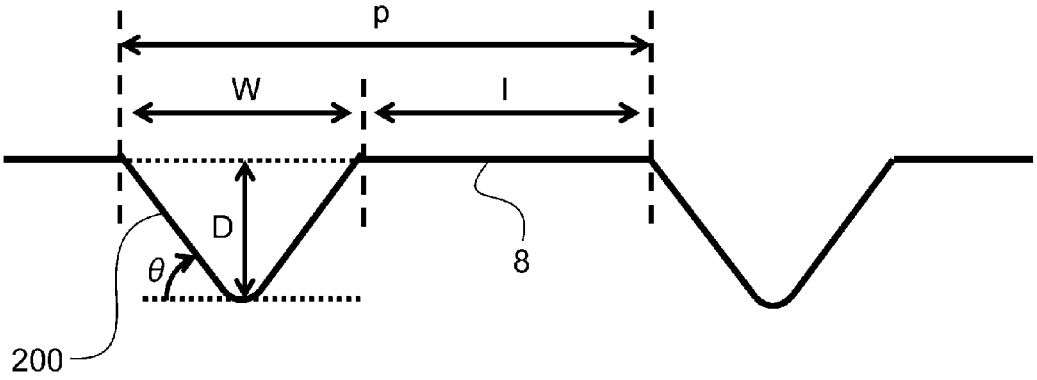

In FIG. 5, (a) is a sectional view of a groove 200 formed at the surface of the developing sleeve 8. In this embodiment, 50 grooves 200 each having a bilaterally symmetrical V-shape in cross section of 40 μm in depth D and 100 μm in width W are formed on the developing sleeve 8 at an interval I of about 770 μm in parallel to an axial line of the developing sleeve 8. The groove interval I is a distance between adjacent two grooves 200 as shown in (a) of FIG. 5.

Figure 6:
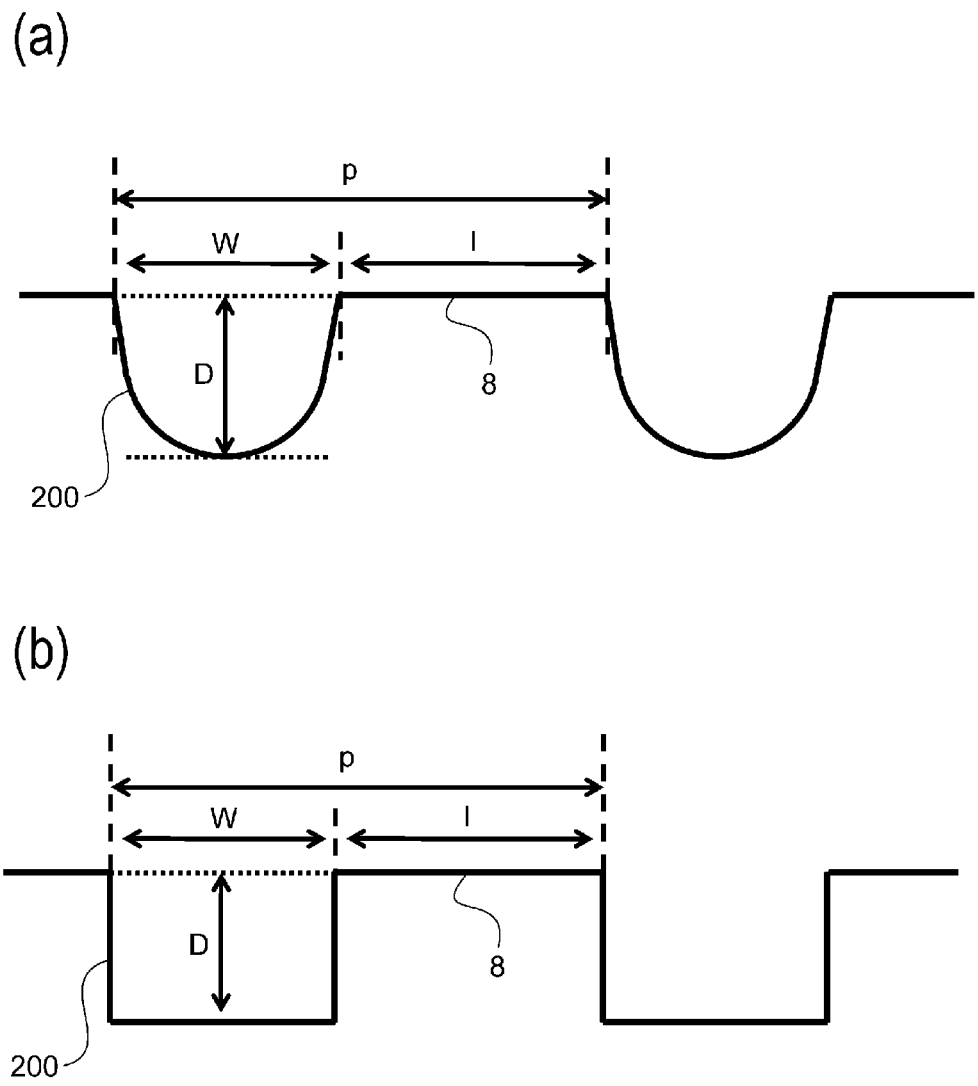
In FIG. 6, (a) and (b) are sectional views each showing a modified example of the grooves formed on the developing sleeve.

In the figure, a pitch p between the adjacent two grooves 200 is p=W+I=870 μm in this embodiment. Further, an angle θ of the V-shaped groove is about 50 degrees. The groove shape is not limited to the V-shape in cross section so long as the developer T is caught by and fed along the groove portion, but may also be, e.g., a V-shape with a U-shaped bottom in cross section as shown in (b) of FIG. 5, a U-shape in cross section as shown in (a) of FIG. 6, or a rectangular shape in cross section as shown in (b) of FIG. 6. However, in either case, in order to catch the developer, there is a need that at least one carrier particle enters the groove 200, and therefore it has been known by study of the present inventor that the carrier radius is smaller than the depth D of the groove 200, and the carrier diameter is smaller than the width W of the groove 200.

Figure 7:
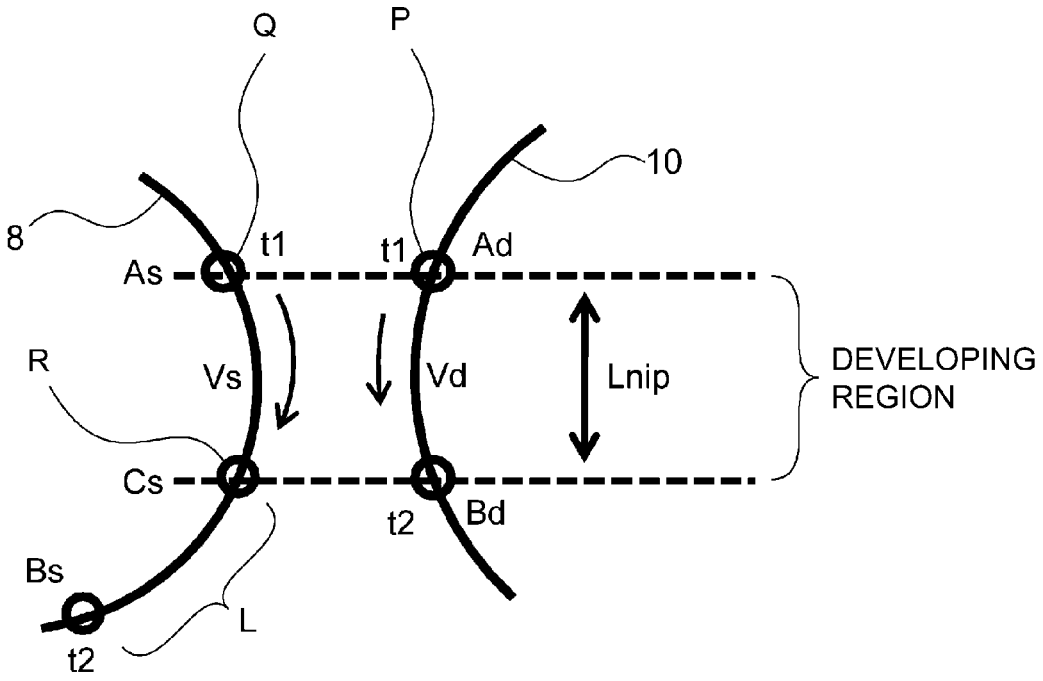
FIG. 7 is a schematic view showing a state in which a developer is fed between the developing sleeve and a photosensitive drum.

FIG. 7 is a schematic view showing a state in which the developer T is fed between the developing sleeve 8 and the photosensitive drum 10. In this case, a region defined by broken lines is the developing region between the developing sleeve 8 and the photosensitive drum 10 which oppose each other. In FIG. 7, the carrier is omitted from illustration. The developer T is constrained by the grooves 200 (FIG. 2) while forming the magnetic chain by the magnetic roller 8' incorporated in the developing sleeve 8.

Figure 8:
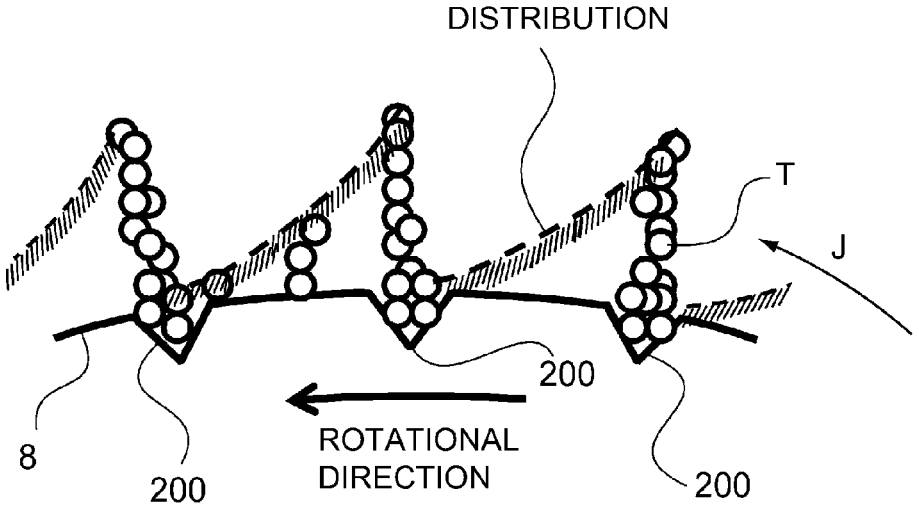
FIG. 8 is a sectional view showing a state in which the developer is carried on the developing sleeve.

FIG. 8 is a sectional view showing a state in which the developer T is carried on the developing sleeve 8. As shown in FIG. 8, the developer T positioned between the adjacent two grooves 200 receives a force from the magnetic chain constrained by an upstream groove 200 with respect to a developer feeding direction I and is pushed and fed toward a downstream side with respect to the developer feeding direction J. For this reason, the density of the developer T on the surface of the developing sleeve 8 is not microscopically constant, but is large at the position of the groove 200 and gradually decreases toward the downstream side from the groove 200 with respect to the developer feeding direction J.

In this way, when the density of the developer T on the surface of the developing sleeve 8 becomes non-uniform, a density non-uniformity resulting from this non-uniformity grooves on the toner image on the photosensitive drum 10. This will be described specifically.

Figure 9:
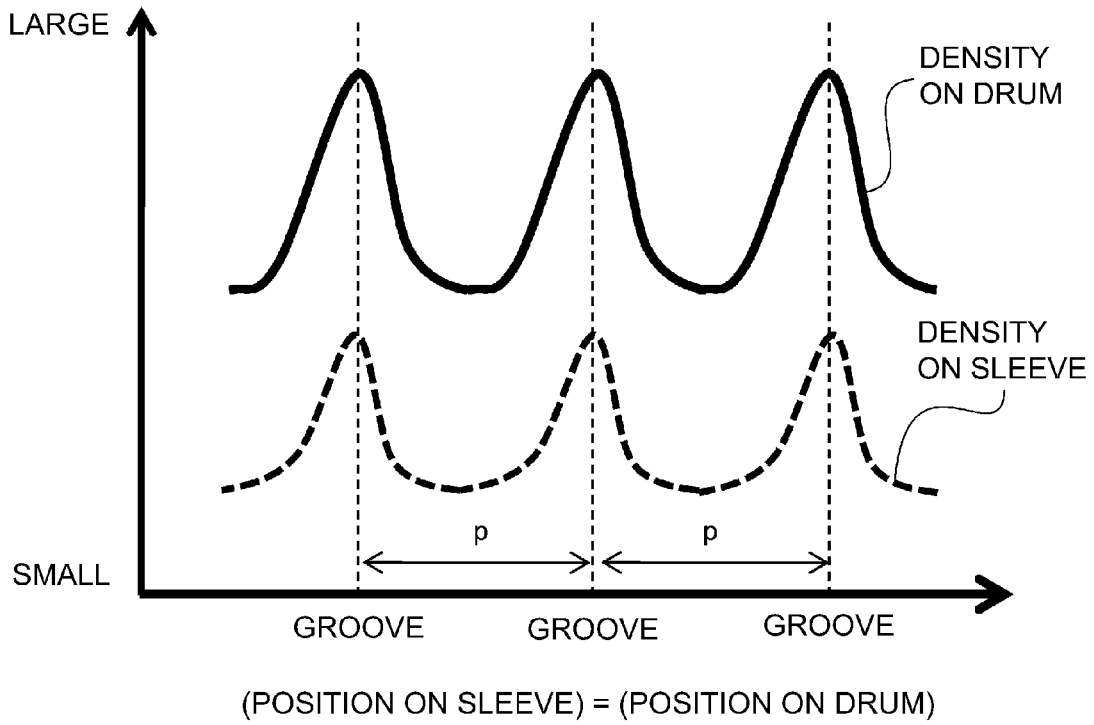
FIG. 9 is a graph showing a relationship between a developer density on the developing sleeve between grooves with respect to a developer feeding direction and a density on the photosensitive drum.

FIG. 9 is a graph showing a relationship of the density (concentration) of the developer T on the developing sleeve 8 and the density of the developer T on the photosensitive drum 10, between the grooves 200 with respect to the developer feeding direction J. In general, when the developer T enters in a large amount between the photosensitive drum 10 and the developing sleeve 8 which constitutes the developing region, also the toner exists in a large amount correspondingly, so that the image is thick when the same developing condition is set. For this reason, in the case where the peripheral speed ratio of the developing sleeve 8 to the photosensitive drum 10 is 1, when the developer T shows the density distribution as shown in FIG. 8, the density non-uniformity corresponding to the density of the developer T generates on the surface of the photosensitive drum 10 as shown in FIG. 9.

However, in general, the peripheral speed ratio of the developing sleeve 8 to the photosensitive drum 10 is larger than 1, and is roughly 1.0 or more and 2.5 or less, and therefore the density non-uniformity on the surface of the photosensitive drum 1 and the density of the developer T on the surface of the developing sleeve 8 do not establish one-to-one correspondence.

Referring again to FIG. 7, a state of the developing region when the peripheral speed ratio of the developing sleeve 8 to the photosensitive drum 10 is larger than 1 will be described. At a first time t1, a position of the point P in a most upstream side of the photosensitive drum 10 in the developing region is Ad, and a position of a point Q in a most upstream side of the developing sleeve 8 in the developing region is As. Then, at a second time t2, the position of the point P goes to a position Bd in a most downstream side of the photosensitive drum 10 in the developing region, and the position of the point Q goes to a position Bs.

A point on the surface of the developing sleeve 8 in a most downstream side in the developing region is a point R, and a position thereof is Cs. When a time at which the point P reaches the most downstream point in the developing region is t2, the electrostatic image at the point P is developed in the developing region in a time (t2−t1), during which a preceding length (width) L=Bs−Cs on the surface of the developing sleeve 8 passes through an opposing portion of the point P with respect to the circumferential direction.

In FIG. 7, Vs and Vd are peripheral speeds of the developing sleeve 8 and the photosensitive drum 10, respectively. The preceding length L of the preceding region of the developing sleeve 8 relative to the photosensitive drum 10 is represented by the following equation (1) when a length (width) of the developing region is Lnip, a radius of the photosensitive drum 10 is Rd, a radius of the developing sleeve 8 is Rs, and the peripheral speed ratio of the developing sleeve 8 to the photosensitive drum 10 is α=Vs/Vd.

$$L=2[\alpha\times Rd\times\arcsin(Lnip/2Rd)-Rs\times\arcsin(Lnip/2Rs)] \quad (1)$$

The length of the developing region with respect to the circumferential direction refers to a distance of a rectilinear line connecting the most upstream point Ad and the most downstream point Bd of the photosensitive drum 10 in the developing region as shown in FIG. 7. The length Lnip of the developing region with respect to the circumferential direction can be obtained by measuring a length (width) of the toner deposited on the surface of the photosensitive drum 10 when the developing device 104 is driven to develop the electrostatic image in the same state as in the state during the image formation and in a state in which the photosensitive drum 10 is stopped. In this case, care should be taken that a driving condition of the developing device 104, a bias to be applied, a positional relationship and a distance between the photosensitive drum 10 and the developing sleeve 8 are made similar to those during the image formation.

A potential of the photosensitive drum 10 may only be required to be such an extent as to develop the electrostatic image into the toner image on the photosensitive drum 10 even when the photosensitive drum 10 is not subjected to the laser exposure. Although the potential is changed depending on the developing bias and the toner, in the case of the two-component developer containing the negative toner as in this embodiment, the potential may only be required to be larger than the DC voltage component of the developing bias by roughly about 50 V to 100 V.

In the case of this embodiment, the DC component of the developing bias is −500 V, and therefore the potential of the photosensitive drum 10 may preferably be −400 V to −450 V. Further, when a bias application time is excessively long, the toner length (width) on the photosensitive drum 10 becomes larger than an actual value, and therefore may preferably be 1 sec or more and 30 sec or less.

The equation (1) described above holds not only at the point P but also at any point on the photosensitive drum 10, and each of all the points on the photosensitive drum 10 is always overtaken by the developing sleeve 8 in the developing region by the region length (width) L.

Figure 10:
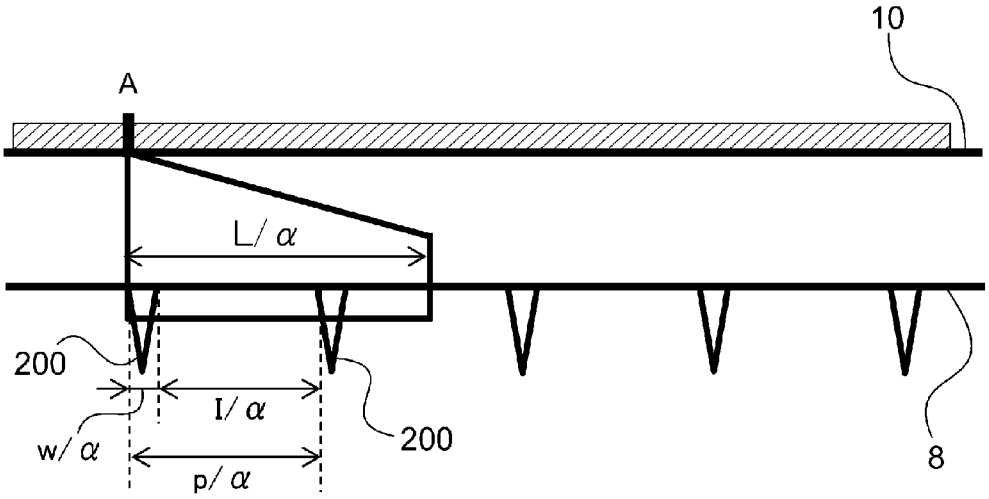
FIG. 10 is a sectional view stirring chamber showing a groove range in which a point A on the photosensitive drum is overtaken in a developing region.

Therefore, at each of the points on the photosensitive drum 10, the preceding region (region length L portion) of the developing sleeve 8 by which the associated point is overtaken in the developing region continuously exists on the developing sleeve 8 correspondingly to the respective points on the photosensitive drum 10. The distance on the photosensitive drum 10 corresponds to $1/\alpha$ time the distance on the developing sleeve 8, and therefore a state of the groove 200 by which each of the points on the photosensitive drum 10 is overtaken is shown in FIG. 10. This will be specifically described.

FIG. 10 is a sectional view stirring chamber showing a range of the grooves 200 by which the point A on the photosensitive drum 10 is overtaken in the developing region. A trapezoid having the base of $L/\alpha$ in length shows the preceding region (preceding length L portion). The point A is overtaken by two grooves 200. In FIG. 10, reference symbols w, I and p represent the groove width, the groove interval and the groove pitch, respectively.

Figure 11:
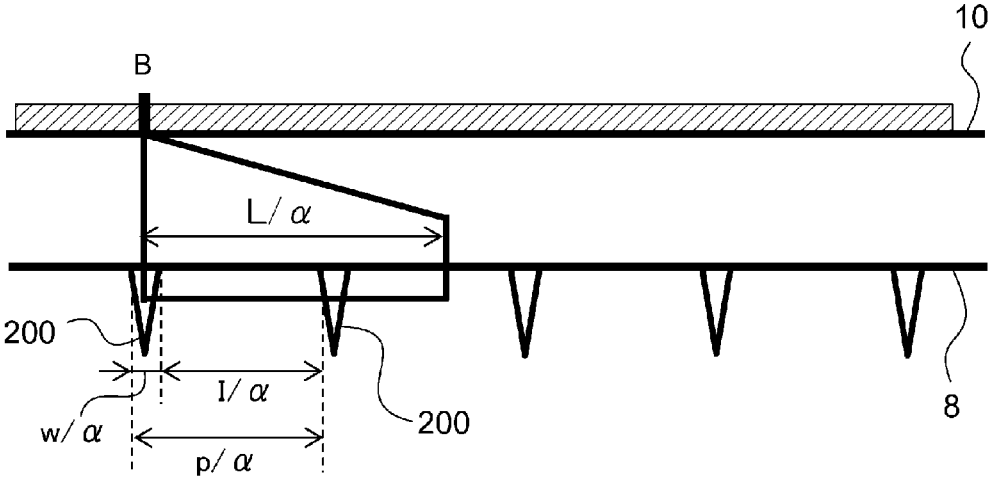
FIG. 11 is a sectional view stirring chamber showing a groove range in which a point B spaced from the point A on the photosensitive drum by a distance shorter than w/$\alpha$ is overtaken in the developing region.

FIG. 11 is a sectional view stirring chamber showing a range of the groove 200 by which a point B spaced from the point A on the photosensitive drum A by a distance shorter than $w/\alpha$. Inside the preceding region (preceding length L portion), there is only one groove 200.

Figure 12:
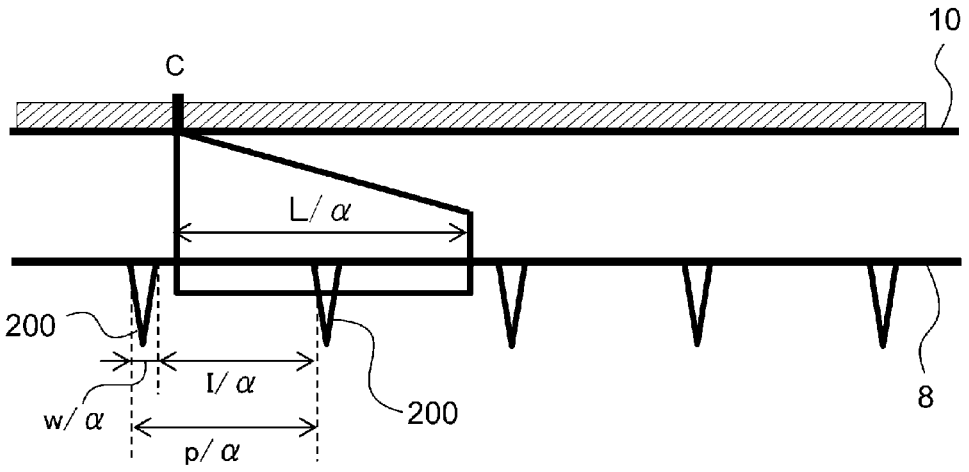
FIG. 12 is a sectional view stirring chamber showing a groove range in which a point C spaced from the point A on the photosensitive drum by a distance long than w/$\alpha$ and shorter than (2p−L)/$\alpha$ is overtaken in the developing region.

FIG. 12 is a sectional view stirring chamber showing a range of the groove 200 by which a point C is spaced from the point A on the photosensitive drum A by a distance longer than $w/\alpha$ and shorter than $(2p-L)/\alpha$. Inside the preceding region (preceding length L portion), there is just one groove 200.

Figure 13:
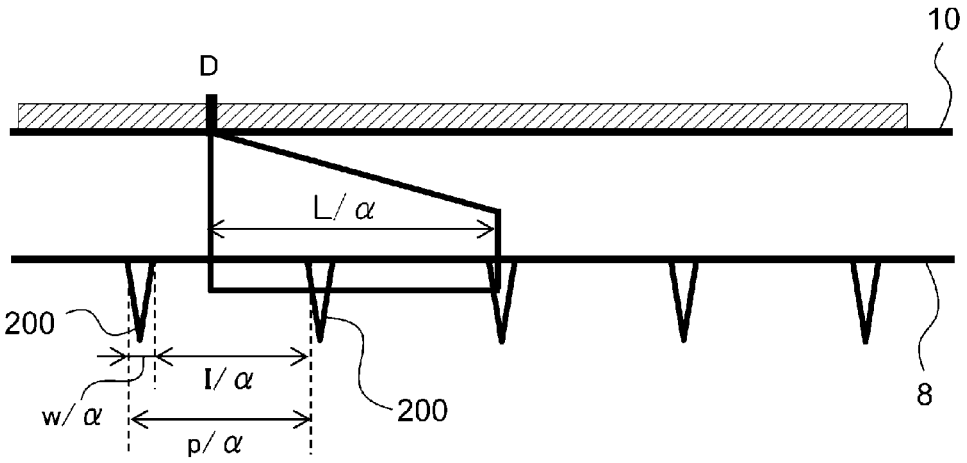
FIG. 13 is a sectional view stirring chamber showing a groove range in which a point D spaced from the point A on the photosensitive drum by a distance longer than (2p−L)/$\alpha$ and shorter than (2p+w−L)/$\alpha$ is overtaken in the developing region.

FIG. 13 is a sectional view stirring chamber showing a range of the groove 200 by which a point D is spaced from the point A on the photosensitive drum A by a distance longer than $(2p-L)\alpha$ and shorter than $(2p+w-L)\alpha$. Inside the preceding region (preceding length L portion), there is only one groove 200.

Figure 14:
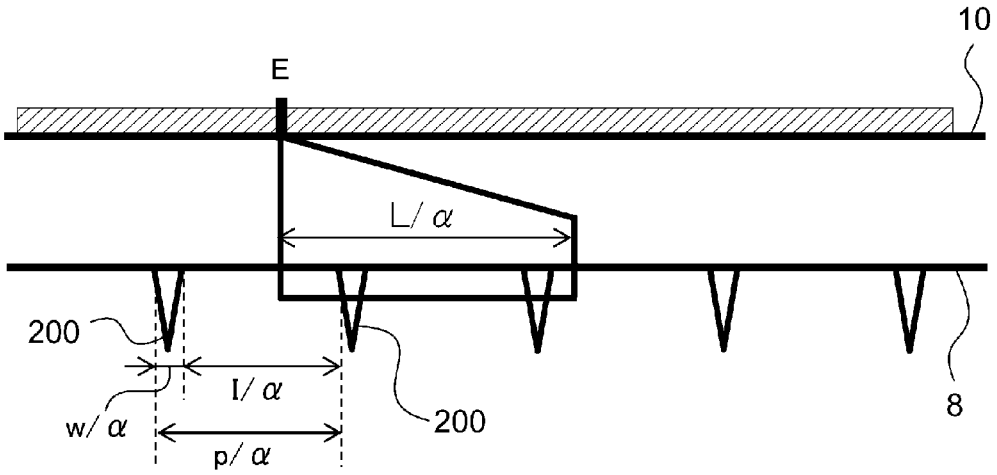
FIG. 14 is a sectional view stirring chamber showing a groove range in which a point E spaced from the point A on the photosensitive drum by a distance longer than (2+w−L)/$\alpha$ and shorter than p/$\alpha$ is overtaken in the developing region.

FIG. 14 is a sectional view stirring chamber showing a range of the groove 200 by which a point E is spaced from the point A on the photosensitive drum A by a distance longer than $(2p+w-L)/\alpha$ and shorter than $p/\alpha$. Inside the preceding region (preceding length L portion), there are just two grooves 200.

Further, the respective points in a region spaced from the distance A by a distance longer than $p/\alpha$ are repetitively overtaken by the single groove 200 and the two grooves 200. In this way, the number of grooves 200 passing through each of the points is not constant but periodically fluctuates, and a degree of the fluctuation is determined by the developing region length (width) Lnip, the preceding length (width) L of the preceding region, the peripheral speed ratio $\alpha$, and the groove pitch p of the groove 200. However, the fluctuation period itself of the number of grooves 200 passing through each of the points on the photosensitive drum 10 is $p/\alpha$, and therefore is determined only by the peripheral speed ratio $\alpha$ and the groove pitch p.

Figure 15:
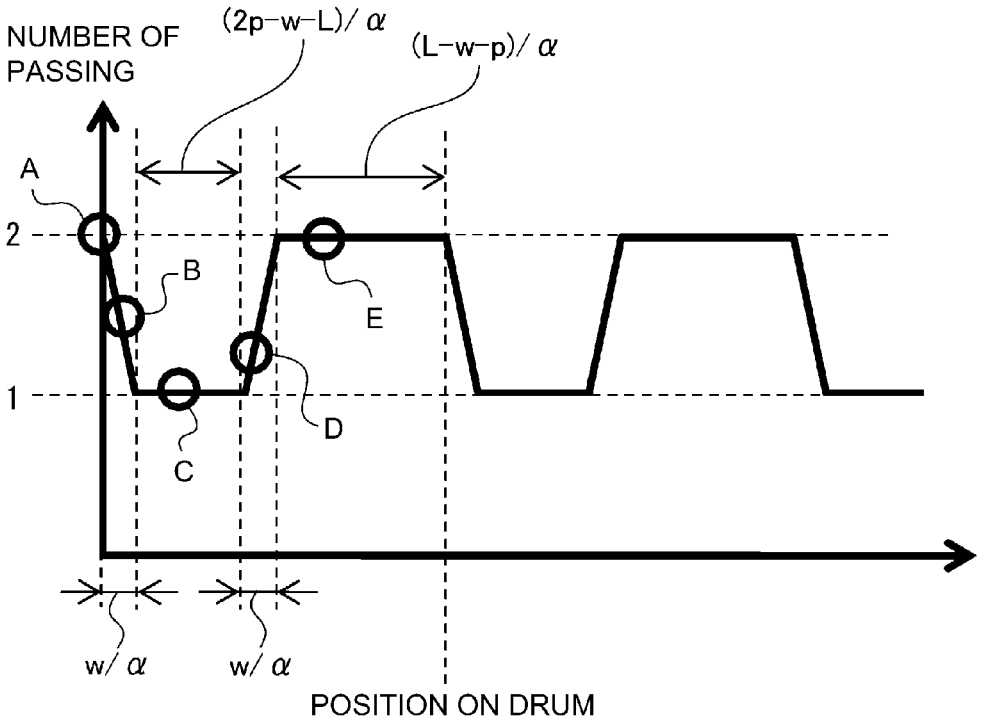
FIG. 15 is a graph showing the number of times the groove passes through each of the points when p+w L≤2p holds.

FIG. 15 is a graph showing the number of times of passing of the grooves 200 through each of the points on the photosensitive drum 10 in the cases described with reference to FIGS. 10-14, i.e., when $p+w \leq L < 2p$. As shown in FIG. 15, the number of times of passing of the grooves 200 through the surface of the photosensitive drum 10 comes and go between one and two. In this case, the density non-uniformity on the surface of the photosensitive drum 10 is liable to groove.

On the other hand, when $L=np$ where n is a natural number, i.e., in the case where the preceding region (preceding length L portion) is just an integral multiple, excluding zero, of the groove pitch p, the number of times of passing of the groove 200 in the developing region at an arbitrary position on the photosensitive drum 10 can be made n times (i.e., constant). From this result, the number of grooves 200 of the developing roller 30 passing through a predetermined position with respect to the circumferential direction on the surface of the photosensitive drum 10 in the developing region is always a certain natural number multiple.

The number of times of passing of the grooves 200 can be made constant, and therefore the density non-uniformity of the surface of the photosensitive drum 10 is suppressed. This will be described below.

Figure 16:
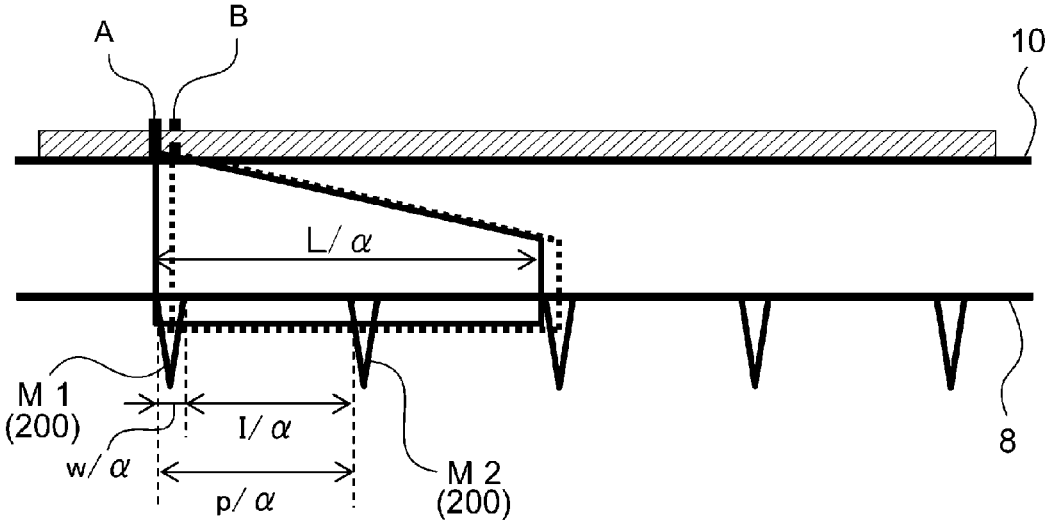
FIG. 16 is a sectional view stirring chamber showing a groove range in which the point A on the photosensitive drum is overtaken in the developing region when L=2p holds.
Figure 17:
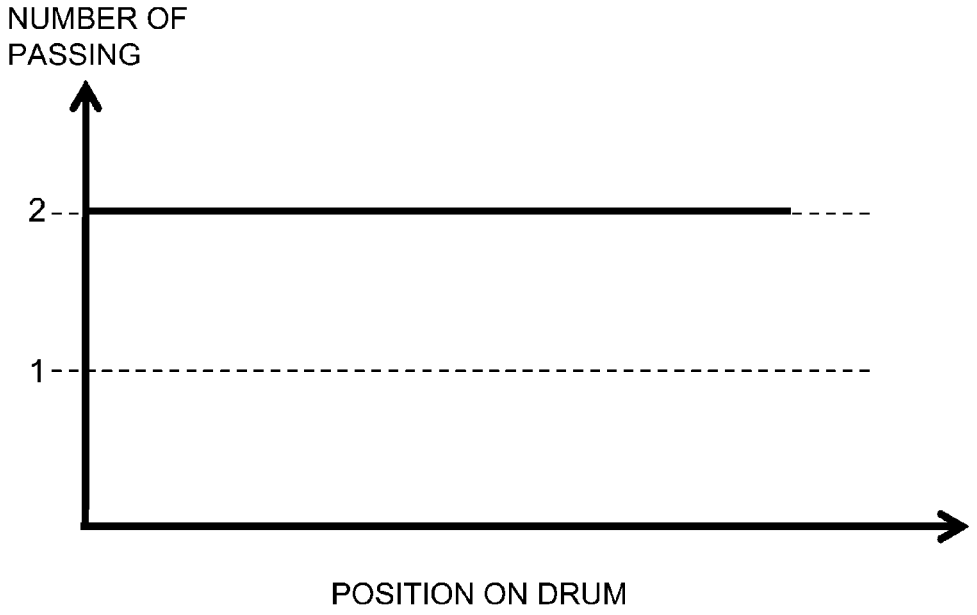
FIG. 17 is a graph showing the number of times the groove overtakes an arbitrary point on the photosensitive drum.

FIG. 16 is a sectional view stirring chamber showing a range by which the point A on the photosensitive drum 10 is overtaken in the developing region when $L=2p$ holds. In FIG. 16, a trapezoid of $L/\alpha$ in base length represents the preceding region (preceding length L portion), and the point A is overtaken by two grooves 200 in the developing region. With respect to the point B adjacent to the point A, the preceding region (preceding length L portion) does not include a part of a groove M1 opposing the point A but includes a part of a groove M2 spaced from the groove M1 by two groove pitches, and the sum of the part of the groove M1 and the part of the groove M2 corresponds to just one groove width (length).

Therefore, also with respect to the point B, the preceding region (preceding length L portion) includes just two grooves. In this way, in the case of $L=2p$, with respect to any point on the photosensitive drum 10, the number of grooves by which the point is overtaken in the developing region is always n.

As described above, with respect to each of the points on the photosensitive drum 10, the number of grooves 200 by which the point is overtaken in the developing region is determined by the following values. That is, the number of grooves 200 is determined by the developing region length Ln, the preceding length $L=2[\alpha \times Rd \times \arcsin(Lnip/2Rd)-Rs \times \arcsin(Lnip/2Rs)]$ of the preceding region, the peripheral speed ratio $\alpha$ and the groove pitch p.

Further, the density of the developer T on the developing sleeve 8 is large at the grooves 200 and is small at non-groove portions, and therefore the density on the photosensitive drum 10 becomes large (thick) corresponding to a larger number of times of the grooves passing through the point on the photosensitive drum 10 in the developing region. Therefore, the density non-uniformity depending on the number of times of grooves passing through each of the points on the photosensitive drum 10 appears on the toner image (i.e., on the output image).

<Experiment>

Figure 18:
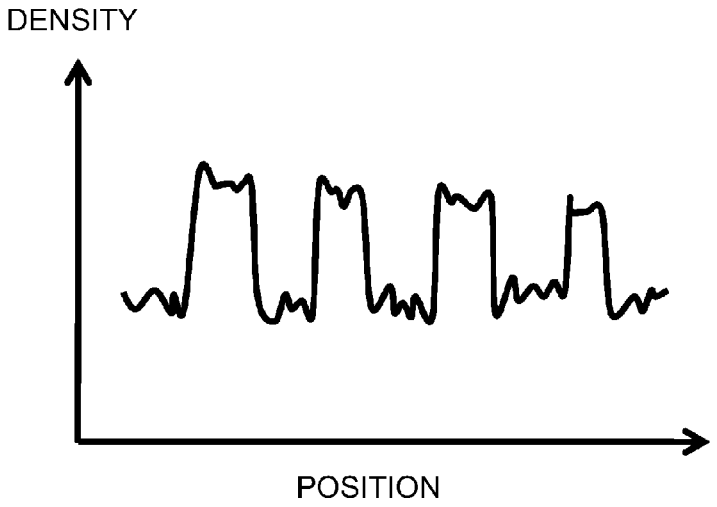
In FIG. 18, (a) and (b) are graphs each showing a relationship between a density on a transfer material and a position of the transfer material, in which (a) shows Comparison Example, and (b) shows Embodiment 1.
Figure 18:
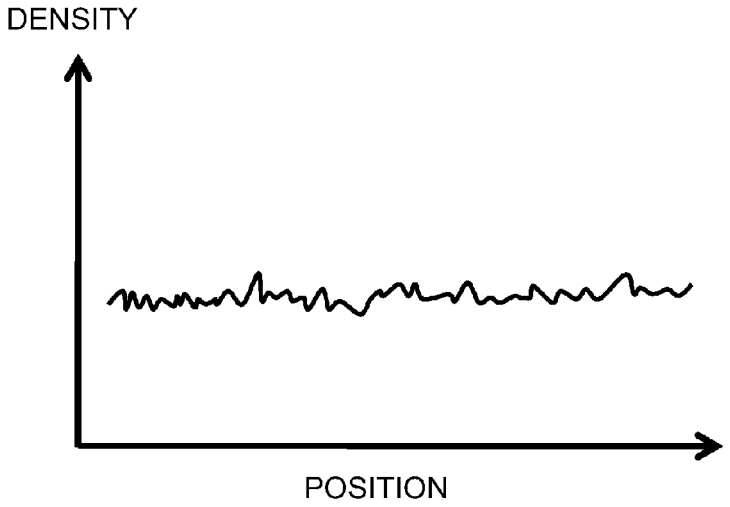

The contents of an experiment showing an effect of this embodiment will be described below. In FIG. 18, (a) is a graph showing a relationship between a density on the transfer material 27 and a position of the transfer material 27 in a Comparison Example. In the Comparison Example, the diameter of the photosensitive drum 10, the diameter of the developing sleeve 8, the shape of the groove 200 and the like are similar to those in Embodiment 1. In the Comparison Example, the peripheral speed ratio α of the developing sleeve 8 to the photosensitive drum 10 is 1.45 (α=1.45), and p=0.87 (mm), w=100 (μm) and Lnip=3 (mm) are set. That is, the Comparison Example is the above-described case of p+w L≤2p.

In FIG. 18, (b) is a graph showing a relationship between a density on the transfer material 27 and a position of the transfer material 27 in Embodiment 1. In Embodiment 1, as described above, the peripheral speed ratio α of the developing sleeve 8 to the photosensitive drum 10 is 1.58 (α=1.58), and p=0.87 (mm), w=100 (μm) and Lnip=3 (mm) are set, so that L=2p=0.74 holds.

As a measuring method of the density non-uniformity, the density of an outputted half-tone image on an A3-sheet was converted into numbers by using a scanner ("Offirio ES-10000G", manufactured by Epson Corp.). In the case of the Comparison Example shown in (a) of FIG. 18, it is understood that the density non-uniformity grooves on the surface of the photosensitive drum 10 every passing of the groove 200, and in the case of Embodiment 1 shown in (b) of FIG. 18, it is understood that conspicuous density non-uniformity does not groove on the surface of the photosensitive drum 10 every passing of the groove 200.

Figure 19:
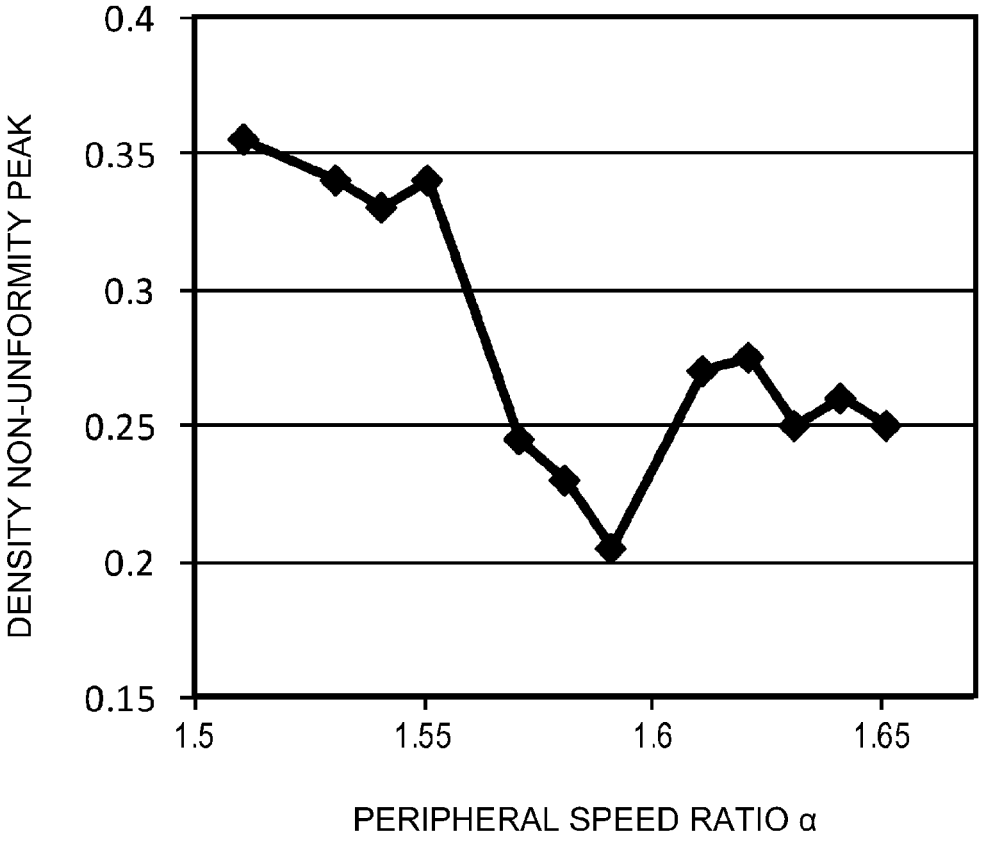

FIG. 19 is a graph in which non-uniformity peak values at portions corresponding to a period of grooves 200 appearing on the photosensitive drum 10 in the case where the diameter of the photosensitive drum 10, the diameter of the developing sleeve 8, the shape of the groove 200 and the like are similar to those in Embodiment 1, and the density non-uniformity image obtained in FIG. 18 is subjected to spectrum analysis using FFT, and only the peripheral speed ratio α is finely changed, are plotted. As shown in FIG. 19, it is understood that the density non-uniformity (peak) intensity largely decreases in a range of 1.56≤α≤1.61 including α=1.581 in Embodiment 1 substantially as the center value.

When L=2p just satisfied theoretically at the value of a of about 1.581 is taken into consideration, according to study by the present inventor, as described above, a density non-uniformity suppressing effect is obtained in a range of about 5% including a center value at which the preceding length L of the preceding region is just an integral multiple of p.

That is, in the case where an error of the range of about ±5% is taken into consideration in the case of L=2p, the following relationship may holds. As a precondition, a line speed of the developing roller 30 is Vs, a line speed of the photosensitive drum 10 is Vd, and the peripheral speed ratio of the developing roller 30 to the photosensitive drum 10 is α=Vs/Vd. Further, a radius of the developing roller 30 is Rs, a radius of the photosensitive drum 10 is Rd, a width (length) of the developing region with respect to the circumferential direction is Lnip, the pitch of the groove 200 on the developing roller 30 is p, and an arbitrary natural number is n. In such a case, a relationship of: $(1-0.05)\times np \leq 2[\alpha\times Rd\times \arcsin(Lnip/2Rd)-Rs\times \arcsin(Lnip/2Rs)] \leq (1+0.05)\times np$ is satisfied.

As described above, the number of times of the grooves 200 through an arbitrary position on the photosensitive drum 10 in the developing region is made constant, so that it is possible to suppress generation of the image density non-uniformity on the surface of the photosensitive drum 10 due to the plurality of grooves 200 formed on the surface of the developing roller 30 with a predetermined non-uniformity with respect to the circumferential direction.

According to the present invention, generation of the image density non-uniformity on the image bearing member surface due to the plurality of grooves formed on the outer surface of the developing roller with a predetermined interval can be suppressed.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-106710 filed on May 23, 2014, which is hereby incorporated by reference herein in its entirety.

What is claimed is:

1. An image forming apparatus comprising:

a developer carrying member capable of carrying a developer containing a toner and a carrier, wherein said developer carrying member includes therein a magnet having a plurality of magnetic poles disposed along a circumferential direction thereof and includes a plurality of grooves formed at an outer surface thereof with a predetermined interval with respect to the circumferential direction; and an image bearing member, provided opposed to said developer carrying member, for bearing an electrostatic image, wherein the electrostatic image on said image bearing member is developed with the developer carried on said developer carrying member by applying a developing bias including an AC electric field to a developing region which is an opposing portion between said developer carrying member and said image bearing member, and wherein when a linear speed of said developer carrying member is Vs, a linear speed of said image bearing member is Vd, a peripheral speed ratio of said developer carrying member to said image bearing member is α=Vs/Vd, a radius of said developer carrying member is Rs, a radius of said image bearing member is Rd, a distance of a rectilinear line connecting a most upstream point and a most downstream point in the developing region with respect to the circumferential direction is Lnip, a pitch of the grooves of said developer carrying member is p, and an arbitrary natural number is n, the following relationship is satisfied:

$$(1-0.05)\times np \leq 2[\alpha\times Rd\times \arcsin(Lnip/2Rd)-Rs\times \arcsin(Lnip/2Rs)] \leq (1+0.05)\times np.$$

2. An image forming apparatus according to claim 1, wherein the number of the grooves, of said developer carrying member, passing through a developing roller position at a surface of said image bearing member in the developing region with respect to the circumferential direction is a natural number multiple.

3. An image forming apparatus according to claim 1, wherein the following relationships are satisfied:

(groove depth)>(carrier radius), and (groove width)>(carrier diameter).

* * * * *